US011043176B2

(12) United States Patent
Echols et al.

(10) Patent No.: US 11,043,176 B2
(45) Date of Patent: Jun. 22, 2021

(54) REDUNDANT DISPLAY SYSTEMS AND METHODS FOR USE THEREOF IN SAFETY CRITICAL APPLICATIONS

(71) Applicants: Gregory Frank Echols, Gainesville, GA (US); Kevin Leigh Walsh, Acworth, GA (US); Christopher A. Bailey, Atlanta, GA (US)

(72) Inventors: Gregory Frank Echols, Gainesville, GA (US); Kevin Leigh Walsh, Acworth, GA (US); Christopher A. Bailey, Atlanta, GA (US)

(73) Assignee: International Display Consortium, Alpharetta, GA (US)

( * ) Notice: Subject to any disclaimer, the term of this patent is extended or adjusted under 35 U.S.C. 154(b) by 0 days.

(21) Appl. No.: 16/805,789

(22) Filed: Mar. 1, 2020

(65) Prior Publication Data

US 2020/0279537 A1 Sep. 3, 2020

Related U.S. Application Data

(60) Provisional application No. 62/812,873, filed on Mar. 1, 2019, provisional application No. 62/834,508, filed on Apr. 16, 2019.

(51) Int. Cl.
*G09G 3/36* (2006.01)

(52) U.S. Cl.
CPC ..... *G09G 3/3666* (2013.01); *G09G 2300/043* (2013.01); *G09G 2320/0626* (2013.01); *G09G 2330/08* (2013.01)

(58) Field of Classification Search
CPC ..... G09G 3/3666; G09G 3/36; G09G 3/342; G01C 23/005
See application file for complete search history.

(56) References Cited

U.S. PATENT DOCUMENTS

| | | | |
|---|---|---|---|
| 4,922,240 | A | 5/1990 | Duwaer |
| 5,619,223 | A | 4/1997 | Lee et al. |
| 5,781,164 | A | 7/1998 | Jacobsen et al. |
| 7,023,419 | B2 | 4/2006 | Park |
| 7,295,179 | B2 | 12/2007 | Dunn |
| 7,573,458 | B2 | 8/2009 | Dunn |

(Continued)

OTHER PUBLICATIONS

International Search Report and Written Opinion in counterpart PCT application, dated Jul. 8, 2020.

*Primary Examiner* — Sardis F Azongha
(74) *Attorney, Agent, or Firm* — Jennifer Medlin

(57) ABSTRACT

A redundant display uses row and column drivers to control an active matrix of transistors arranged in a pixel array. Row drivers arranged on respective sides of the pixel array control the voltage across entire rows of the pixel array in tandem. One or more sets of column drivers control the voltage across columns of the pixel array. One or more columns of switching elements are disposed between left and right portions of the pixel array. During normal operation, the column of switching elements connects left row portions with right row portions, such that an image is displayed across the entire pixel array. Responsive to a malfunction of row drivers on one side of the pixel array, the column of switching elements isolates the left row portions from the right row portions, such that the image may be displayed only on the other side of the pixel array.

19 Claims, 12 Drawing Sheets

(56) References Cited

U.S. PATENT DOCUMENTS

| | | | | |
|---|---|---|---|---|
| 7,714,384 | B2 | 5/2010 | Dunn | |
| 7,728,788 | B1 | 6/2010 | Echols et al. | |
| 7,924,263 | B2 | 4/2011 | Dunn | |
| 8,704,751 | B2 | 4/2014 | Dunn et al. | |
| 9,117,417 | B2 | 8/2015 | Dunn et al. | |
| 9,418,603 | B2 | 8/2016 | Dunn et al. | |
| 9,666,148 | B2 | 5/2017 | Dunn et al. | |
| 9,953,561 | B2 * | 4/2018 | Wang | G09G 3/20 |
| 9,997,118 | B2 | 6/2018 | Dunn et al. | |
| 10,037,723 | B2 | 7/2018 | Abernathy | |
| 10,056,045 | B2 | 8/2018 | Dunn et al. | |
| 10,127,848 | B2 * | 11/2018 | Kang | G09G 3/20 |
| 10,852,156 | B2 * | 12/2020 | Bushell | G01C 23/005 |
| 2009/0284500 | A1 * | 11/2009 | Yamashita | G09G 3/3666 345/204 |
| 2013/0176318 | A1 | 7/2013 | Dunn et al. | |

* cited by examiner

REDUNDANT DISPLAY SYSTEMS AND METHODS FOR USE THEREOF IN SAFETY CRITICAL APPLICATIONS

CROSS-REFERENCE TO RELATED APPLICATIONS

This application claims priority to U.S. Provisional Application No. 62/812,873 filed Mar. 1, 2019 and U.S. Provisional Application No. 62/834,508 filed Apr. 16, 2019, the contents of which are hereby incorporated by reference.

TECHNICAL FIELD

The present invention relates to display systems using row and column drivers to control an active matrix of transistors to display information, such as an Active Matrix Liquid Crystal Displays (AMLCDs) or simply, Liquid Crystal Displays (LCDs), or Organic Light Emitting Diode (LED) displays. More specifically, the present invention relates to display systems used in safety critical applications where redundancy is desired to maintain functionality under adverse environments.

BACKGROUND

AMLCDs (also referred to herein as LCDs) are commonly employed for presenting information to a user or users. Typically, an LCD consists of a single display element (i.e., a single large array of colored pixels) for generating static and moving images, for displaying text, for displaying symbols, etc., to a user.

For example, in the aerospace industry, an LCD display can replace multiple analog instrumentation displays by dividing the active viewing area into multiple "windows", with each window displaying a separate piece of information.

LCDs are used under extreme environmental conditions, the LCD may suffer damage and become non-useable. Extreme environmental conditions may include intensely hot or cold conditions and/or conditions with extreme vibrations, mechanical shocks or electromagnetic interferences, such as conditions that may occur in a moving aircraft.

To mitigate the risk of losing critical data, such as flight critical data in an aircraft, the LCDs need to be designed in a manner that incorporates some internal redundancy. With redundancy, if the LCD is only partly damaged, a portion of the display will remain functional, and critical data can be moved to the remaining functional portion of the LCD.

Various techniques have been proposed to incorporate redundancy in LCDs. One well-known technique is to construct the LCD as essentially two side-by-side LCDs with fully independent operation on a single piece of glass. Thus, if the left half LCD is damaged, the right half LCD may still function, and vice-versa. Having completely independent side by side displays requires special considerations to harmonize the LCDs for color and brightness uniformity. If the voltages used to drive the internal transistors vary, then one side may appear brighter or dimmer than the other.

Another technique that has been proposed is to construct the LCDs as two independent LCDs front-to-back. Thus, if the front LCD fails, the rear LCD may still work, and vice-versa.

While these approaches are somewhat effective in providing redundancy, they require LCDs that can only be used separately. This results in a waste of resources, which is a critical concern particularly in a small area, such as an airplane cockpit.

There is thus a need for an LCD that allows for redundancy without requiring two distinct LCDs that can only be used separately.

SUMMARY

The present embodiments relate to system and method for redundant display using row and column drivers to control an active matrix of transistors to display information. A thin-film-transistor (TFT) layer is arranged in a pixel array and includes a plurality of rows of conductors and TFTs. Each row extends from left to right across the entire pixel array. First and second set of row drivers arranged on respective sides of the pixel array control the voltage across entire rows in tandem. The TFT layer also includes a plurality of columns of conductors and TFTs controlled by a set of column drivers, each column extending from top to bottom across the pixel array, and one or more columns of switching elements extending from the top to the bottom of the pixel array. The column of switching elements is disposed between the conductors and TFTs in a left portion of the pixel array and the conductors and TFTs in a right portion of the pixel array. During normal operation, the column of switching elements connects left row portions with right row portions, such that voltages are applied which cause an image to be displayed across the entire pixel array. Responsive to a malfunction of the first set or the second set of row drivers on one side of the pixel array, the column of switching elements isolates the left row portions from the right row portions, such that voltages from the remaining functional row drivers on the other side of the pixel array are applied to the liquid crystal material on that side of the column of switching elements which cause the image to be displayed only across a left portion or a right portion of the pixel array.

BRIEF DESCRIPTION OF SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawing(s). Understanding that these drawing(s) depict only typical embodiments of the invention and are not therefore to be considered to be limiting of its scope, the invention will be described and explained with additional specificity and detail through the use of the accompanying drawing(s) in which.

DETAILED DESCRIPTION

According to illustrative embodiments, an AMLCD system includes a single LCD panel that provides redundancy by having two sets of row drivers and two sets of backlights. This is different from a conventional AMLCD system that includes one set of row drivers and one back light.

Many details of an LCD that would be understood by those skilled in the art are not repeated here. For purposes of this application, a short description of a conventional AMLCD system is provided below with reference to FIG. 1A, followed by relevant details of the illustrative embodiments.

Figure 1A:
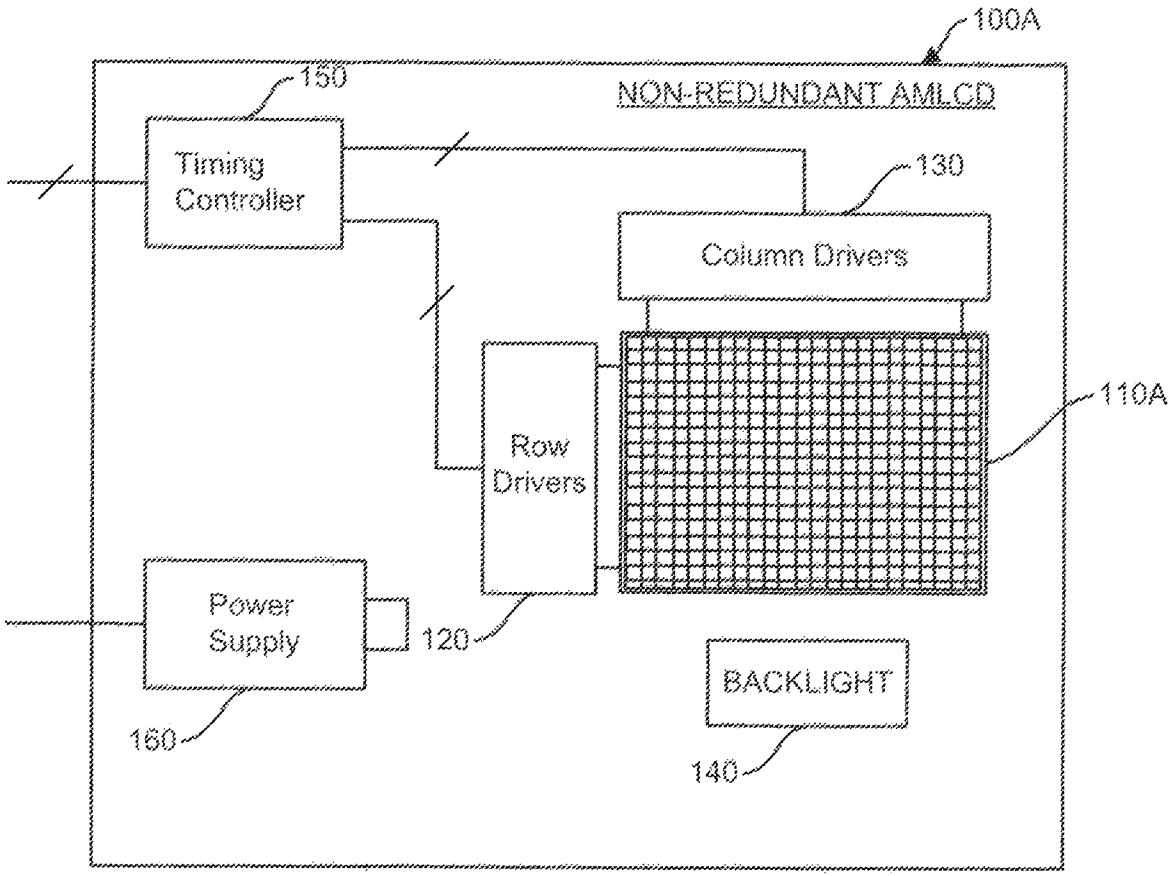
(PRIOR ART) FIG. 1A
FIG. 1A illustrates a conventional non-redundant AMLCD system including one set of row drivers.

Referring to FIG. 1A, a conventional non-redundant AMLCD system 100A is shown from a top view. As those skilled in the art will appreciate, an LCD contains several layers which work in combination to create a viewable image. Although not shown for simplicity of illustration, the LCD includes a liquid crystal material. The liquid crystal material is located between front and rear transparent plates. The front plate is generally referred to as the "color filter" (CF) layer, and the rear plate is generally referred to as the "thin film transistor" (TFT) layer. In FIG. 1A, only the TFT layer 110A is shown for simplicity of illustration.

The liquid crystal material may be actively configured to pass or block a certain amount of light which is originating from a backlight 140 in response to an applied voltage/charge from conductors in the TFT layer. The conductors in the TFT layer 110A can apply specific voltages to the liquid crystal material, causing localized alignment of the liquid crystal material. This alignment affects the transmissibility of light rays of light from the backlight 140 through the LCD, Selective alignment and non-alignment of the liquid crystal material caused by the voltages applied to the conductors in the TFT layer 110A cause an image to be displayed which is visible through an external face of the LCD.

As depicted in FIG. 1A, a traditional TFT array 110A includes a plurality of rows of conductors extending from left to right and a plurality of columns of conductors extending from top to bottom (shown as a grid in FIG. 1A). The rows and columns of conductors are arranged in an array of regions referred to as pixels. As those skilled in the art will appreciate, a transistor is preferably placed within each pixel.

Row drivers 120 and column drivers 130 are in electrical communication with a timing controller 150. Although not shown, a video source including two driver cards supplies the video data to be displayed, which may be communicated via the timing controller 150. The driver cards provide drive signals to the row drivers 120 and the column drivers 130.

The timing controller 150 provides the proper timing for displaying the video data, and the row drivers 120 and the column drivers 130 generate the proper charge/voltage to cause the image to be displayed. In particular, the row drivers 120 are used to apply voltages to the rows of conductors from a top row to a bottom row, and the column drivers 130 are used to apply voltages to the columns of conductors, from a left-most column to a right-most column.

A power supply 160 may provide power through the timing controller 150 to the row drivers 120 and the column drivers 130. Each pixel in the assembly can be controlled when a respective row driver activates the row of conductors in which include the pixel, while the respective column driver activates the corresponding column of conductors which include the pixel.

The TFT array 110A requires the operation of the row drivers 120, the column drivers 130, the timing controller 150, the power supply 160, and the backlight 140 to create an image. If any of these devices were to fail, then the entire LCD would fail to create an image. This is sometimes referred to as a 'single point failure.' As discussed above, the failure of the entire LCD is undesirable but has traditionally been a significant risk for LCD displays.

Figure 1B:
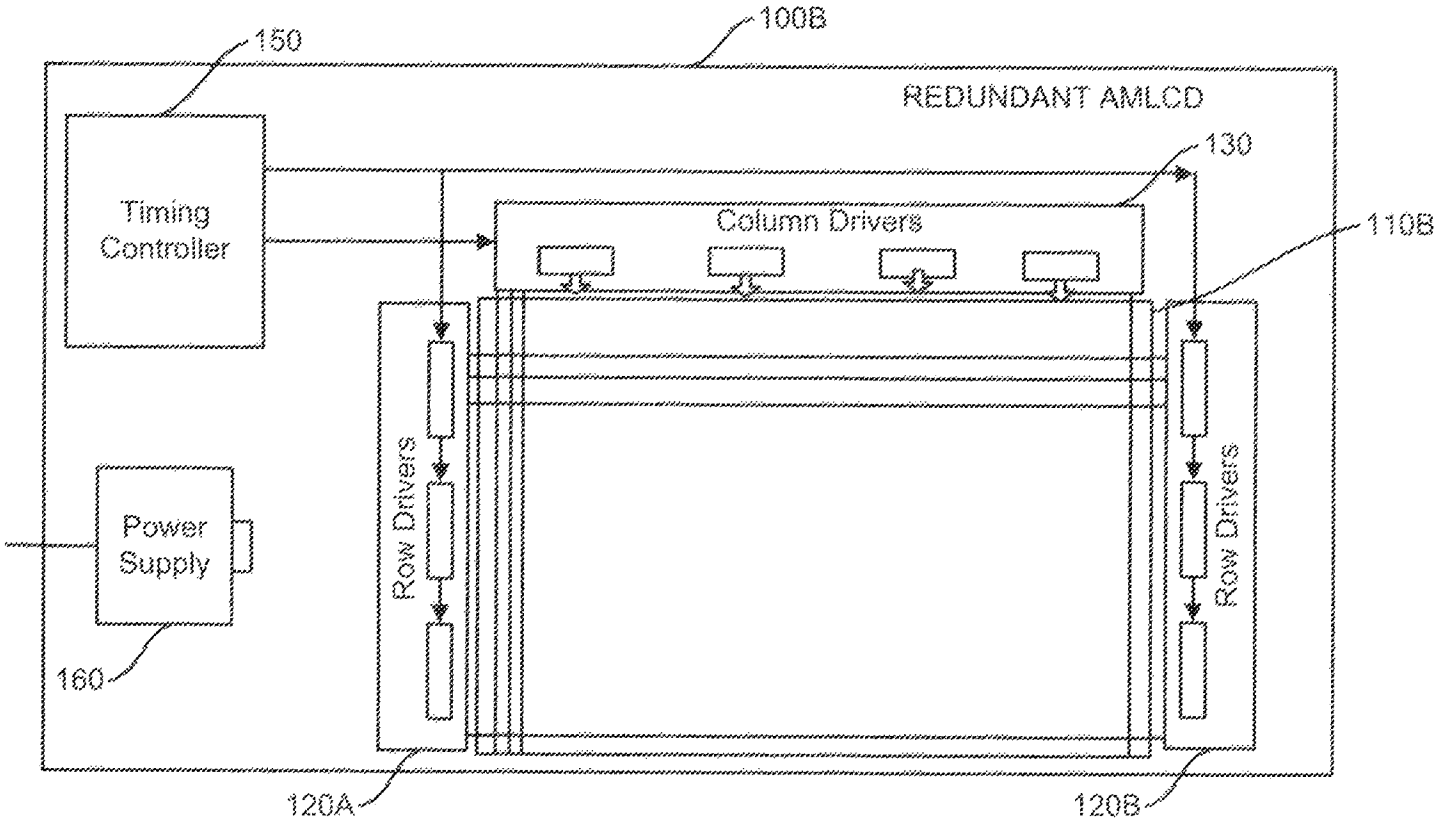
(PRIOR ART) FIG. 1B
FIG. 1B illustrates a conventional non-redundant AMLCD system including two sets of row drivers.

On large displays where the length of the rows is long, capacitive loading can lead to propagation delay and voltage differences between the pixels at the start of the row and the end of the row. To alleviate this issue, the rows can be driven with row drivers 120A and 120B on the left and right sides, respectively, of a TFT array 110B in tandem, as in the AMLCD system 100B shown in FIG. 1B.

An LCD will not function satisfactorily without an appropriate and properly-functioning set of row and column drivers. If, for example, the row drivers fail, the entire LCD may fail to create an image. In configurations with a second row driver, such as that shown in FIG. 1B, a failure in one row driver may still cause the LCD to fail to function correctly, depending on the nature of the failure. If the failing row driver upsets the voltage on the row, either by creating a short circuit to ground or another voltage source, the improper voltage will propagate across the entire length of one or more rows of pixels causing the entire line to fail.

Figure 1C:
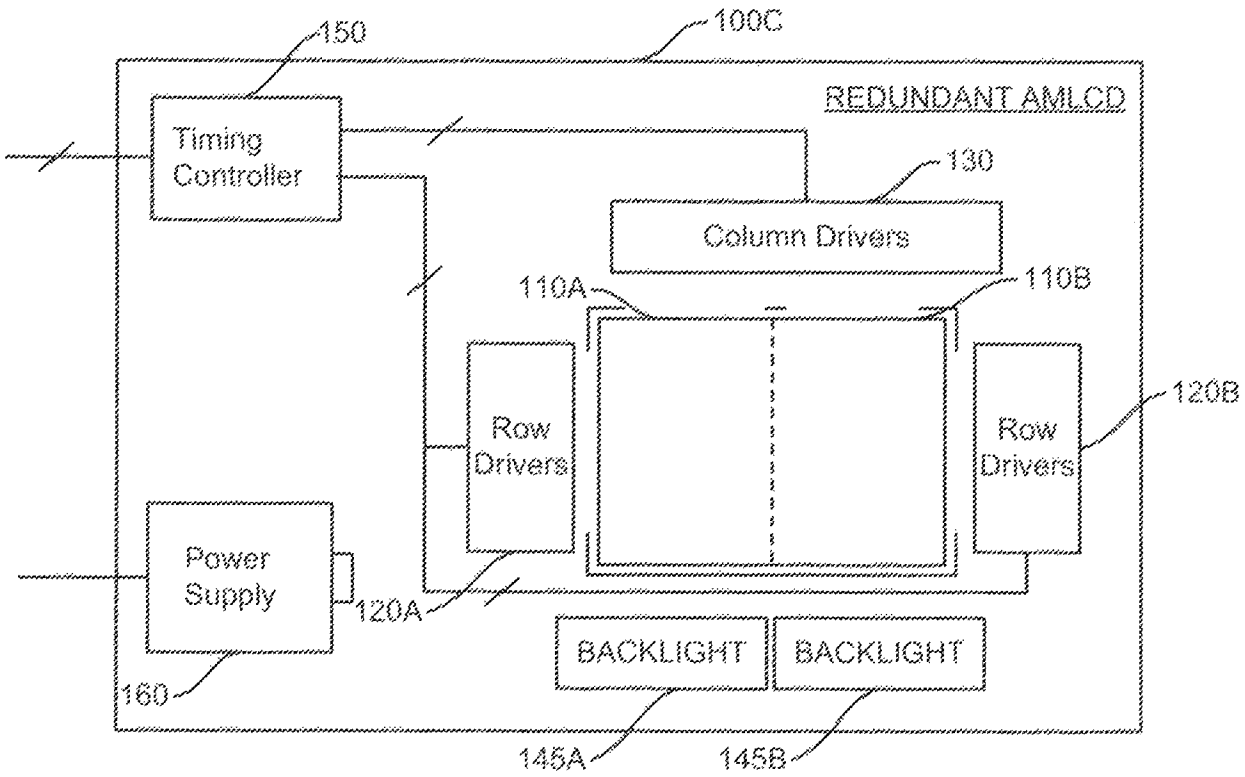
(PRIOR ART) FIG. 1C
FIG. 1C illustrates a conventional dual redundant AMLCD system including two independent AMLCDs.
Figure 2A:
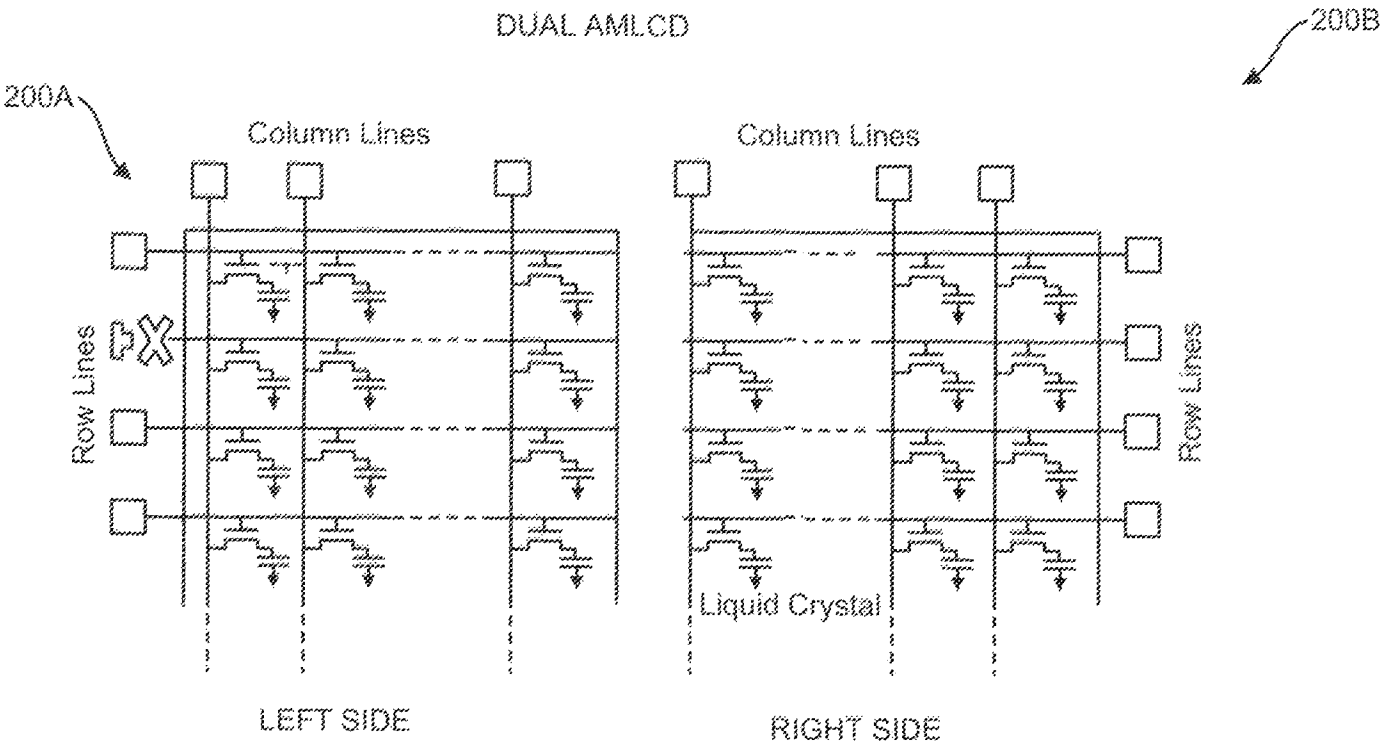
FIG. 2A illustrates conventional TFT arrays included in a conventional dual redundant AMLCD system.

In a dual-redundant AMLCD 100C with two independent AMLCDs having two TFT arrays 110A and 110B on a single master piece of glass as shown in FIG. 1C, the failure of a row driver 120A or 120B results in the loss of that row of information within 110A or 110B. This may be further understood with reference to FIG. 2A which illustrates a conventional dual AMLCD including two TFT arrays 200A and 200B.

Figure 2B:
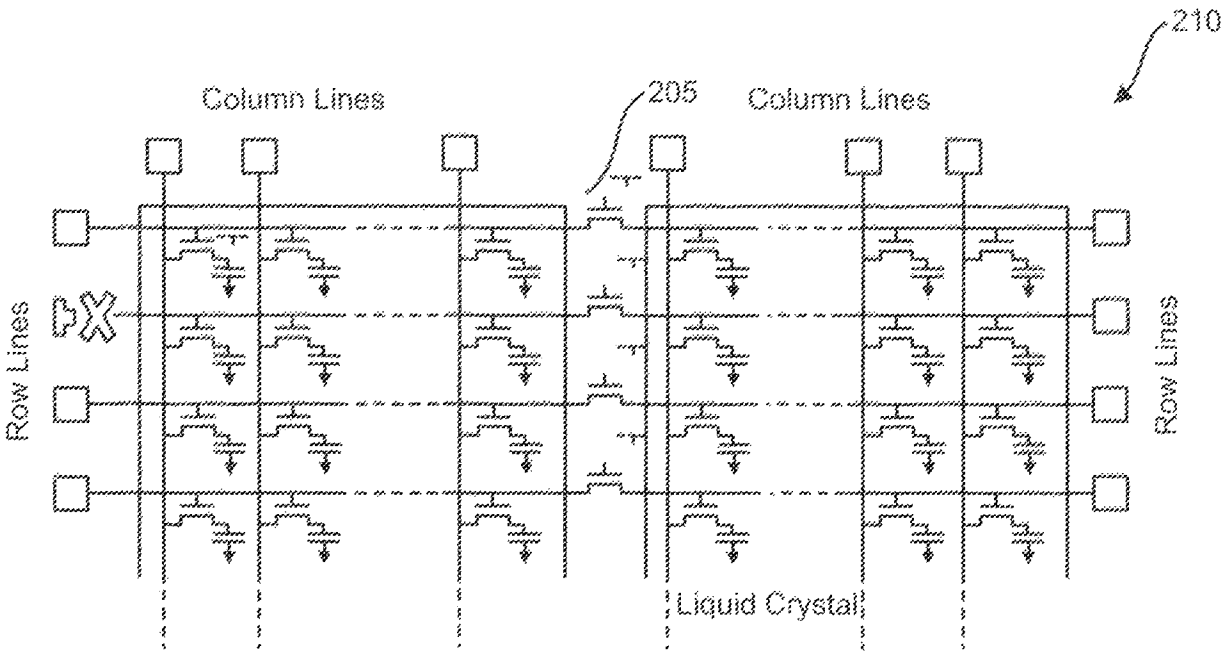
FIG. 2B illustrates a TFT array including a column of transistors according to an illustrative embodiment.

According to illustrative embodiments, an AMLCD system is provided that provides for continuous display of an image across an entire pixel array during normal operation. Each row is driven from both sides of the pixel array, e.g., the left side and the right side. In normal operation, an intermediate switching element is closed, allowing current to flow through from the left to right side. In the event of a failure of a row driver on one side, when the switching element is open, it may possible to continue to display the image across the entire row of the display if the row driver on the opposite side is capable of maintaining the proper voltage. That is, if the switching element is, for example, a transistor, the row information may be carried across the transistor, as illustrated in FIG. 2B described in detail below.

Figure 1D:
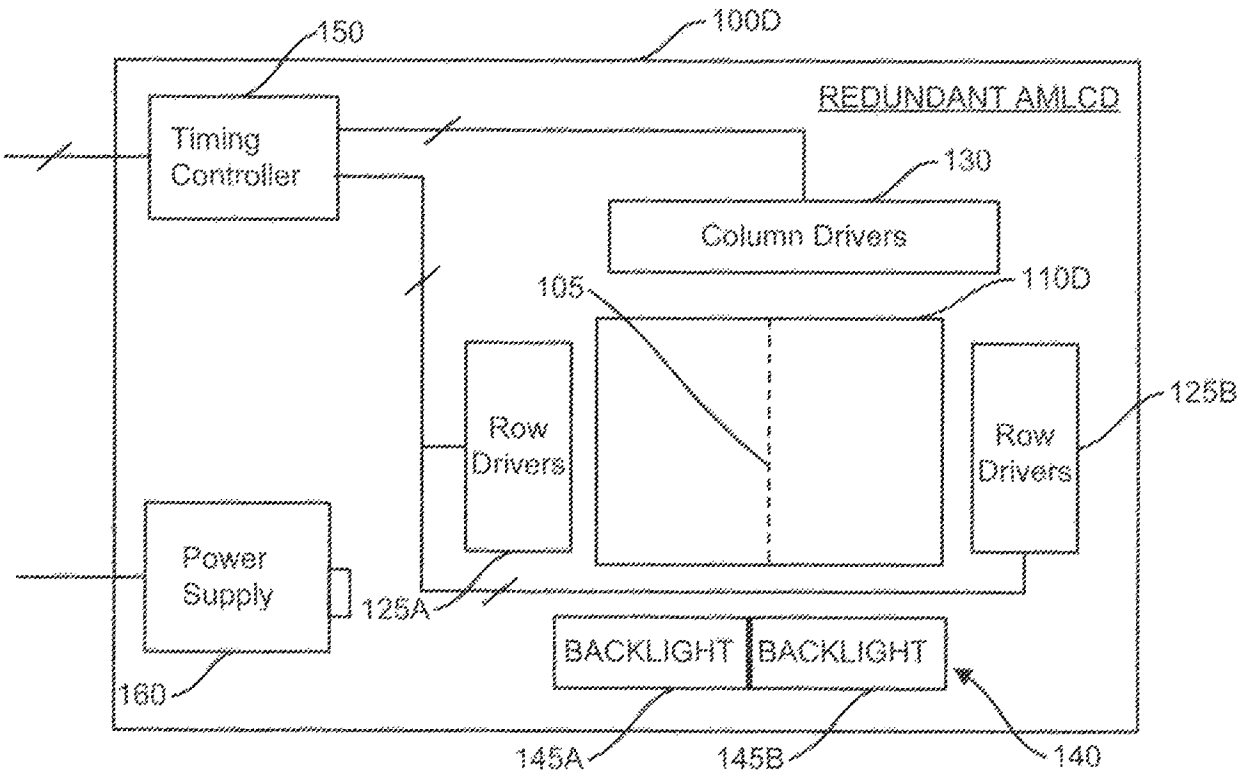
FIG. 1D illustrates a redundant AMLCD system according to an illustrative embodiment.

This may be understood with reference to FIG. 1D which illustrates a redundant AMLCD system 100D according to an illustrative embodiment. The AMLCD system 100D includes some components similar to those of a conventional AMLCD system, such as the timing controller 150 and the power supply 160. Also, although not shown, a video source may supply video data.

Instead of the TFT array 110A, the AMLCD system 100D includes a TFT array 110D shown from a top view in FIG.

1D. Similar to the TFT array 110A, the TFT array 110D includes a plurality of rows of conductors and a plurality of columns of conductors arranged in an array of pixels. Also, each pixel includes a TFT (shown in more detail in FIGS. 2B-4).

In the AMLCD system 100D shown in FIG. 1D, instead of having one set of row drivers, two sets of row drivers 125A and 125B are included on respective sides of the TFT array 110D. Both sets of row drivers 125A and 125B are in electrical communication with the timing controller 150. Both the "left" set of row drivers 125A and the "right" set of row drivers 125B apply voltages to each of the entire rows of conductors in tandem. Although shown on the left and right sides of the TFT array 110D, it should be appreciated that the sets of row drivers 125A and 125B may be positioned in other areas relative to the TFT array 110D.

As can be seen from FIG. 1D, column drivers 130 are also in electrical communication with the timing controller 150 and are used to apply voltages to the columns of conductors across the width of the pixel array. Although column drivers 130 are depicted as controlling the columns of conductors of the TFT array 110D from the top, it should be appreciated that the column drivers 130 may, instead, control the columns of conductors of the TFT array 110D from the bottom.

The power supply 160 may provide power through the timing controller 150 to the row drivers 125A, 125B and the column drivers 130.

During normal operation, the entire LCD is operated in a continuous left-right dual mode. Every column in the pixel array is individually addressed from a top or bottom edge as in a "normal"' LCD, but each row is addressed from both the left and right sides simultaneously by both sets of row drivers 125A and 125B. The dual sets of row drivers cut the propagation delay of the row (scan) line signal by half during normal operation. The display may have no gap or a small gap between the left and right sides and would look and function like one single display until a malfunction occurs.

According to illustrative embodiments, the TFT array 110D includes a "middle" column of switching elements 105 disposed between a left portion of the pixel array and a right portion of the pixel array. It should be appreciated that although the column of switching elements 105 is shown as being in the middle of the pixel array, the column of switching elements may be included anywhere in the pixel array, e.g., to the left of the middle of the pixel array or to the right of the middle of the pixel array.

When any portion of the driving system on one side fails, such as if one set of row drivers fails, the column of switching elements 105 is opened, isolating the side of the pixel array driven by the non-failing portion of the drive system from the side of the pixel array driven by the non-failing portion of the drive system, hence maintaining the operation of the non-failing row portion of the drive system. For example, responsive to a malfunction of a set or row drivers on one side of the TFT array 110D, the column of switching elements 105 isolates the left row portions from the right row portions, such that voltages from the remaining functional row drivers on the other side of the TFT array 110D are applied to the liquid crystal material on that side of the column of switching elements 105, which causes the image to be displayed only across a left portion or a right portion of the pixel array.

Thus, the LCD may be effectively be operated as a single large display (during normal operation) or as two independent side-by-side displays (during malfunctioning of any portion of the drive system for one side, such as a set or row drivers). The column of switching elements 105 may be implemented with transistors, fuses, or resistors according to various embodiments described below.

In addition, while the set of column drivers 130 controls conductors in columns across the entire width of the pixel array during normal operation, the set of column drivers 130 may be configured such that during abnormal operation (e.g., failure of either of the set of row drivers 125A or 125B) or responsive to a user command, a portion of the column drivers may output voltages that cause a black screen image to be displayed. For example, if the row drivers 125A fail, column drivers on the left side of the pixel array may output voltages that cause a black screen image to be displayed.

The AMLCD system 100D also includes a backlight which can operate as a single backlight 140 or as two backlights 145A and 145B. Each backlight may contain independent light source such as light emitting diode (LED) strings and LED drivers that have separate control inputs. During normal operation of the AMLCD system 100C, both backlights 145A and 145B are in operation. However, when, for example, row drivers on one side of the pixel array fail, the backlight on that side may be turned off to conserve energy and prevent the display of erroneous information. For example, if the row drivers 125B driving the rows of conductors from the right side of the TFT array 110B fail, then the portion of the backlight illustrated as 145B may be turned off.

Referring now to the detailed embodiments, according to a first embodiment, as shown in FIG. 2B, a TFT array 210 includes a middle column of transistors 205 disposed vertically down the middle of the pixel array, splitting each row of conductors into right and left portions. All the gates of the transistors in the column 205 may be driven together by a common user control signal. This column of transistors 205 may be then operated as a switch to isolate the left or the right side of the pixel array from the side driven by malfunctioning row drivers. During normal operation of the AMLCD system, the transistors are turned on to connect the portions of rows of conductors on the left side of the pixel array with the portions of rows of conductors on the right side of the pixel array. When the transistors are on, they serve to keep the row voltage between the two sides of the pixel array the same, allowing for uniform brightness, thus harmonizing the brightness and contrast of the two sides. If a row driver on one side fails in a state which would allow the opposite side to continue to drive the required voltage levels on the entire line, then the opposite end of the drive lines can continue to supply the voltages to maintain the line's full or slightly diminished functionality. However, when a row driver fails such that the voltage levels of the entire row would be affected, or other drive system failure occurs, the transistors turn off to isolate the portions of the rows on the left side from the portions of the rows on the right side.

Figure 3:
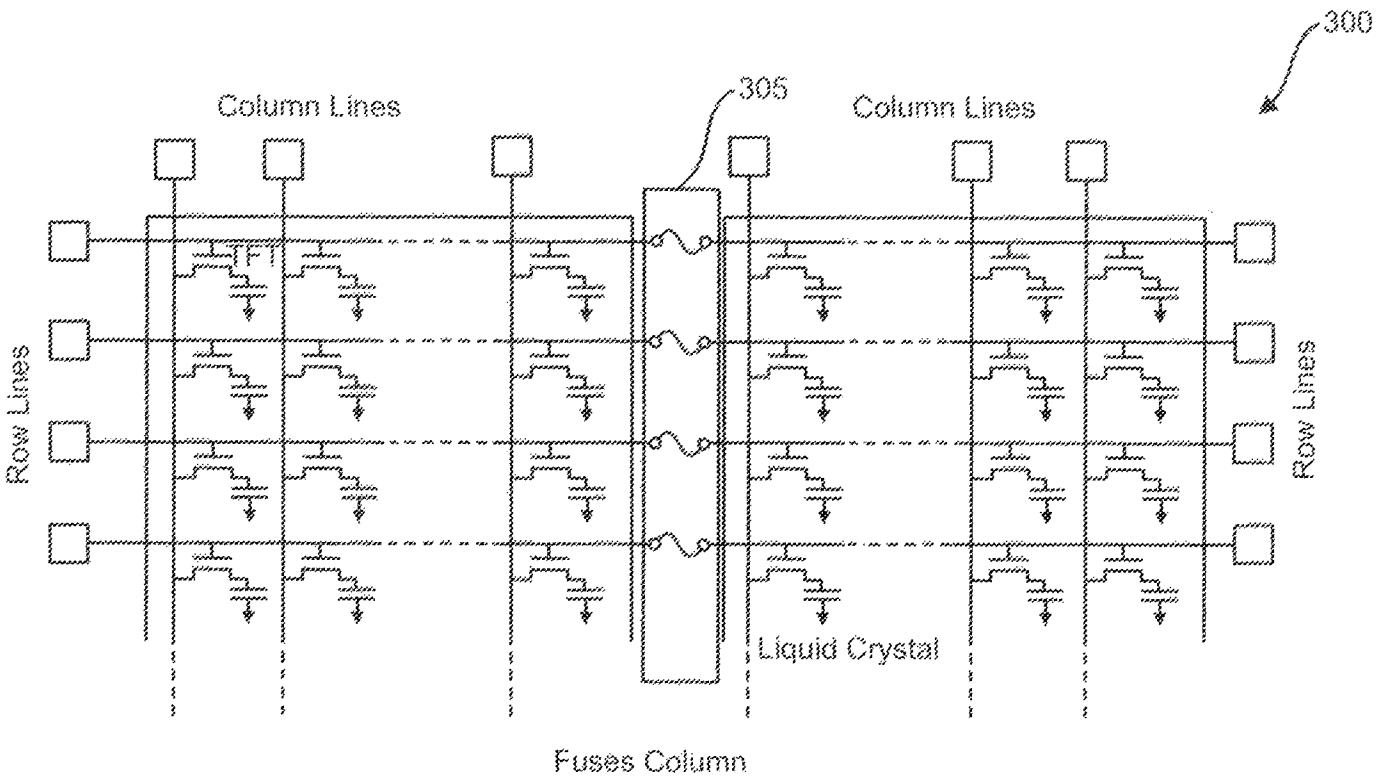
FIG. 3 illustrates a TFT array including a column of fuses according to an illustrative embodiment.

According to a second embodiment, as shown in FIG. 3, a TFT array 300 includes a column of fuses 305 instead of a column of transistors. During normal operation of the AMLCD system, the fuses are intact or closed, such that the portions of rows of conductors on the left side of the pixel array are connected to the portions of rows of conductors on the right side of the pixel array. When the fuses are active (closed), they serve to keep the voltage between the two sides the same, allowing for uniform brightness. In the event that a set of row drivers develops short-circuits at its outputs, an over-current is created that causes the fuses to open up one by one during a vertical scan to disconnect the left portion of rows from the right portion of rows.

Figure 4:
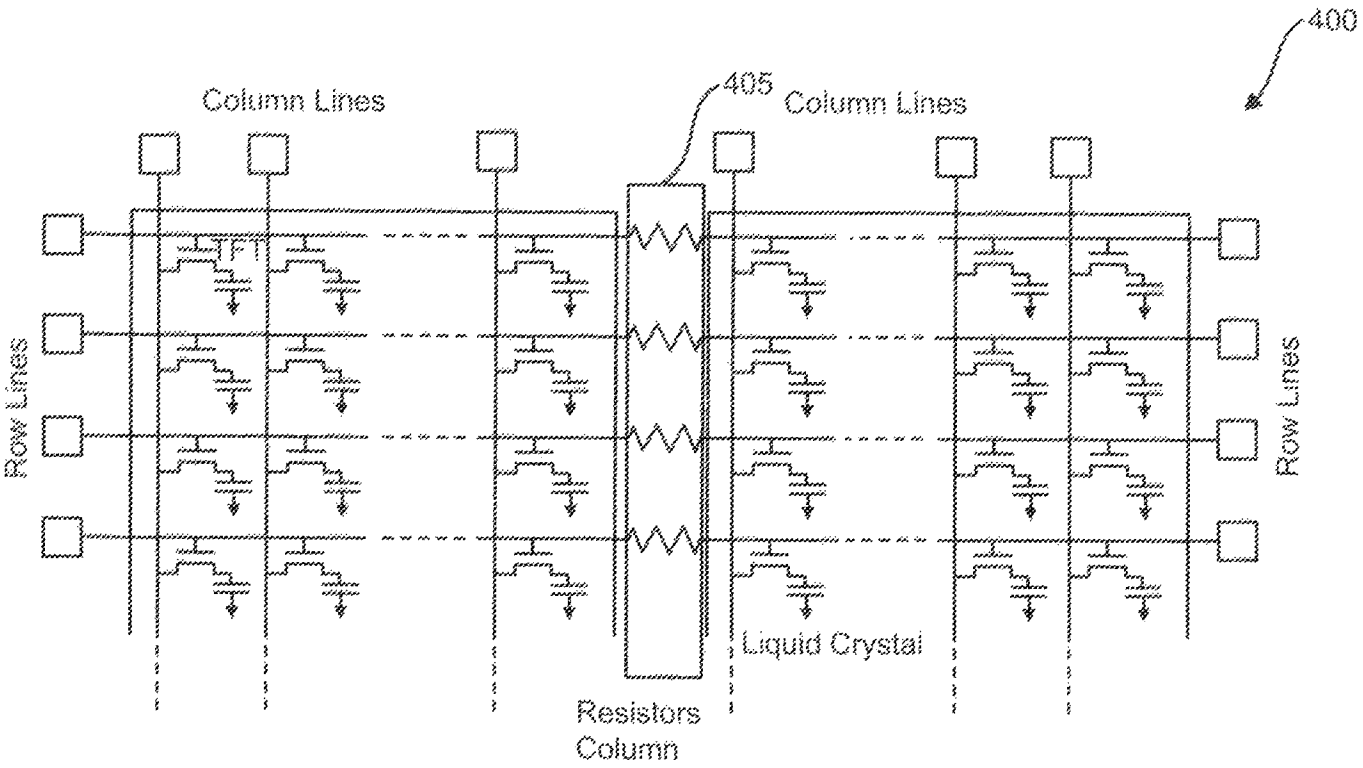
FIG. 4 illustrates a TFT array including a column of resistors according to an illustrative embodiment.

According to a third embodiment, as shown in FIG. 4, a TFT array 400 includes a column of high impedance resistors 405 instead of fuses or transistors. During normal operation of the AMLCD system, the high impedance resistors operate to connect the left portion of rows of the pixel array to the right portion of rows. Also, during normal operation, the high impedance resistors serve to keep the voltage between the two portions of the pixel array closer, allowing for a more uniform brightness. In the event of a malfunction of a set of row drivers, the high impedance resistors can minimize the current flow between the left portion of rows from the right portion of rows. This approach may be considered a "light" separation of the left portion from the right portion that works well just enough to allow a viewer to extract useful information from one side of the display. During normal operation, the resistors allow some current to pass which improves the harmonization of the right and left halves of the display. The impedance of the resistors must be large enough that the current flow from side to side is small enough such that during a failure, the failure on one side does not change the voltage so much that the other side cannot be driven by its, still functional, driver.

Figure 5A:
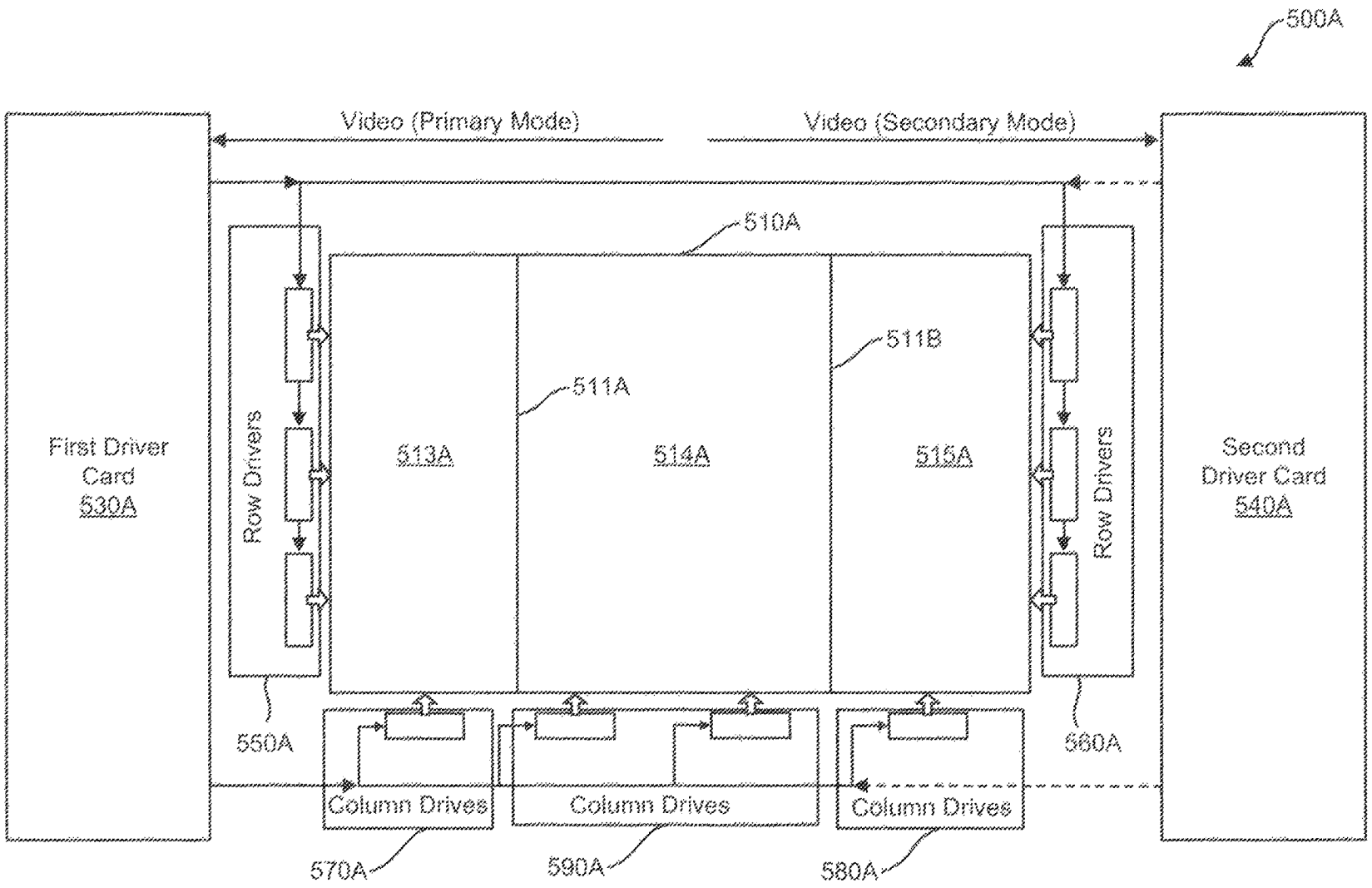
FIG. 5A illustrates a redundant AMLCD system according to another illustrative embodiment.

FIG. 5A illustrates a redundant AMLCD system according to another illustrative embodiment. The AMLCD system 500A shown in FIG. 5A includes a thin film transistor (TFT) array 510A arranged in a pixel array and includes a plurality of rows and columns of conductors and TFTs.

The AMLCD system 500A shown in FIG. 5A includes first and second driver cards 530A and 540A that receive video signals from a video source (not shown) and provide drive signals to row and column drivers. In addition, although not shown, the AMLCD system 500A may also include backlights like the backlights 140, 145A and 145B shown in FIG. 1D. The backlight may function as a single unit supplying light to the entire pixel array or as a first backlight supplying light to a left portion 513A of the pixel array, a second backlight supplying light to a middle portion 514A of the pixel array, and a third backlight supplying light to a right portion 515A of the pixel array.

The AMLCD display system 500A includes first and second sets of row drivers 550A and 560A, respectively. The AMLCD display system 500A also includes first, second and third set of column drivers 570A, 580A, and 590A, respectively. The first driver card 530A is connected to the first and second sets row drivers 550A and 560A and to the first, second and third sets of column drivers 570A, 580A, and 590A. Similarly, the second driver card 540A is connected to the first and second sets row drivers 550A and 560A and to the first, second and third sets of column drivers 570A, 580A, and 590A.

The TFT array 510A also includes first and second columns of switching elements 511A and 511B, respectively, extending from the top to the bottom of the pixel array. The first column of switching elements 511A is disposed between a left portion 513A of the pixel array and a middle portion 514A of the pixel array. The second column of switching elements 512A is disposed between a right portion 515A of the pixel array and the middle portion 514A of the pixel array.

During normal operation, the left, middle and right portions 513A, 514A and 515A of the pixel array are interconnected by the first and second columns of switching elements 511A and 512A, respectively, such that the same voltages are applied to all of the pixels of the array. A single gamma curve is used to adjust all of the voltages so that there is uniform luminance or intensity across the entire pixel array.

During normal operation, the first driver card 530A delivers drive signals to both sets of row drivers 550A and 560A and to all of the column drivers 570A, 580A and 590A such that the entire pixel array, including the left portion 513A, the middle portion 514A and the right portion 515A, is driven by the both sets of row drivers 550A and 560A and by their respective column drivers 570A, 580A and 590A. Alternatively, during normal operation, the entire pixel array may be driven by the second driver card 540A delivering drive signals to all of the row and column drivers.

Either the first driver card 530A or the second driver card 540A can independently drive the display. Thus, if a failure occurs in the first driver card 530A or the second driver card 540A, the failing driver card can be disabled, and the other driver card can drive both sets of row drivers 550A and 560A and all the column drivers 570A, 580A and 590A, thereby driving the entire pixel array with no loss of functionality.

If a failure occurs in the first set of row drivers 550A, causing one or more rows of pixels to fail across the entire pixel array, the first set of row drivers 550A can be disabled, and the left column of switching elements 511A can be opened to isolate the middle and right portions 514A and 515A of the pixel array from the failed row driver 550A and the left portion 513A. In this case, the second set of row drivers 560A continues to drive the rows for the middle and right portions 514A and 515A of the pixel array.

Likewise, if a failure occurs in the second set of row drivers 560A, causing one or more rows to fail across the entire display, the second set of row drivers 560A can be disabled, and the right column of switching elements 511B can be opened to isolate the middle and left portions 513A and 514A of the pixel array from the failed row driver 560A and the right portion 515A. In this case, the first set of row drivers 550A continues to drive the rows for the middle and left portions 513A and 514A of the pixel array.

A similar type of redundancy may be used for the first, second, and third sets of column drivers 570A, 580A, and 590A. That is, if a failure occurs in one or more of the first, second or third sets of column drivers 570A, 580A and 590A, the failing column drivers can be disabled, and the non-failing column drivers can continue to drive the array of pixels.

Although three portions 513A, 514A, and 515A of the pixel array and two columns of switching elements 511A and 511B are shown, it should be appreciated that there may be any number of portions of the pixel array with a corresponding number of switching elements.

Figure 5B:
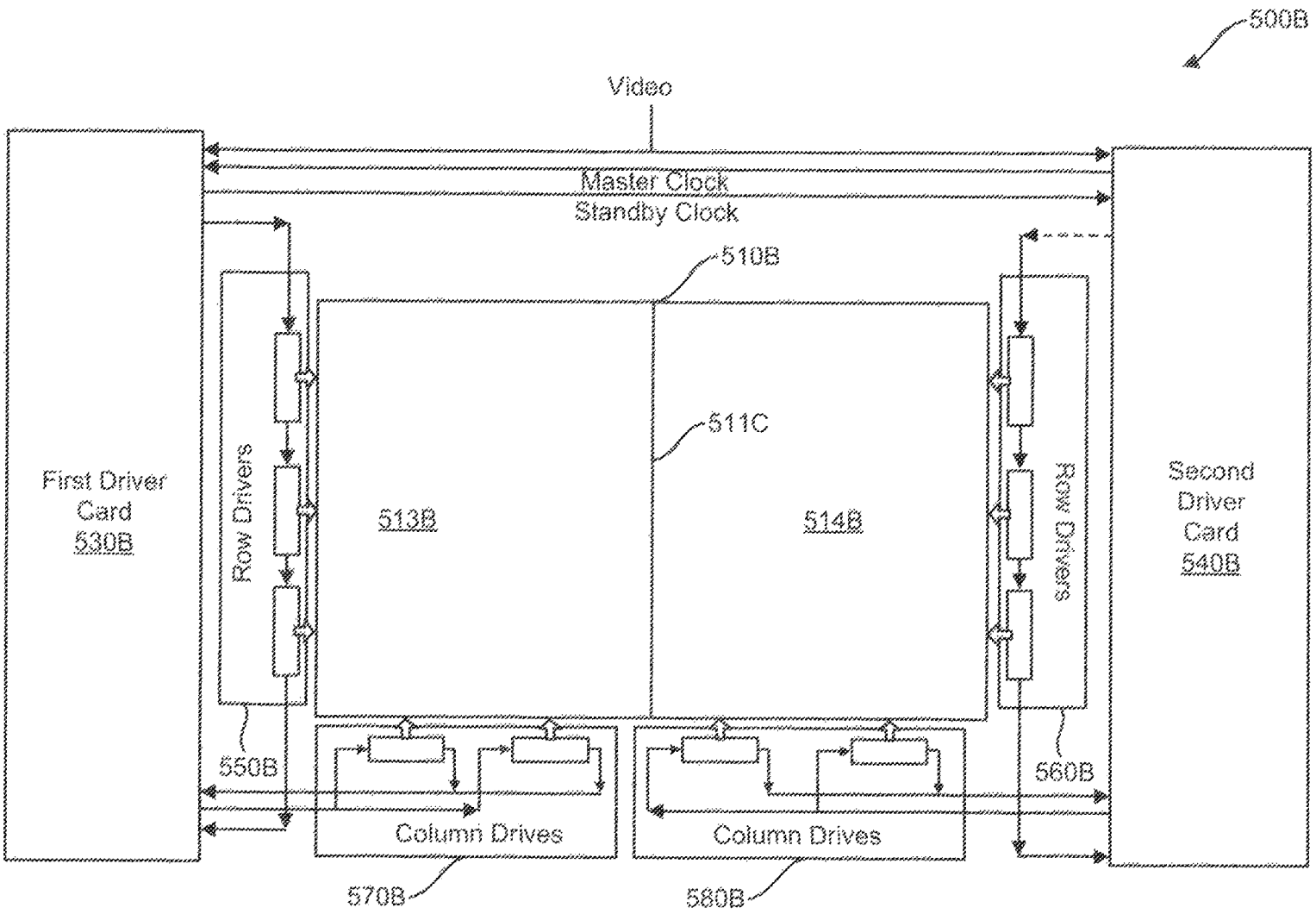
FIG. 5B illustrates a redundant AMLCD system according to another illustrative embodiment.

FIG. 5B illustrates a different embodiment with a similar partitioning of row drivers and pixel array elements but with different driver cards controlling the right row and column drivers. The AMLCD system 500B shown in FIG. 5B includes a thin film transistor (TFT) array 510B arranged in a pixel array and includes a plurality of rows and columns of conductors and TFTs.

The AMLCD system 500B shown in FIG. 5B includes first and second driver cards 530B and 540B that receive video signals from a video source (not shown) and provide drive signals to row and column drivers. In addition, although not shown, the AMLCD system 500B may also include backlights like the backlights 140, 145A and 145B shown in FIG. 1D. The backlight may function as a single unit supplying light to the entire pixel array or as a first backlight and a second backlight supplying light to a left portion 513B of the pixel array and a right portion 514B of the pixel array, respectively The AMLCD display system 500B includes first and second sets of row drivers 550B and 560B, respectively. The AMLCD display system 500B also includes first and second sets of column drivers 570B and 580B, respectively. The first driver card 530B is connected to the first set of row drivers 550B and the first set of column drivers 570B. The second driver card 540B is connected to the second set of row drivers 560B and to second set of column drivers 580B.

The TFT array 510B also includes a column of switching elements 511C extending from the top to the bottom of the pixel array. The column of switching elements 511C is disposed between a left portion 513B of the pixel array and a right portion 514B of the pixel array. It should be appreciated that although the column of switching elements 511C is shown as being in the middle of the pixel array, the column of switching elements may be included anywhere in the pixel array, e.g., to the left of the middle of the pixel array or to the right of the middle of the pixel array.

During normal operation, the first driver card 530B controls the set of column drivers 570B on the left portion 513B of the pixel array, and the right driver card 540B controls the set of column drivers on the 580B on the right portion 514B of the pixel array. The sets of row drivers 530B and 540B are driven from a common clock to ensure that each row is driven simultaneously from both the left side and the right side of the display.

In the event of a failure on the first driver card 530B or a row driver in the set of row drivers 550B, the first driver card 530B can be disabled, and the column of switching elements 511C can be opened to isolate the right portion 514B of the pixel array from the left portion 513B. The right portion 514B of the pixel array may continue to be driven using the second driver card 540B, the set of row drivers 560B, and the set of column drivers 580B.

Similarly, in the event of a failure on the second driver card 540B or a row driver in the set of row drivers 560B, the second driver card 540B can be disabled, and the column of switching elements 511C can be opened to isolate the left portion 513B of the pixel array from the right portion 514B. The left portion 513B of the pixel array may continue to be driven using the first driver card 530B, the set of row drivers 550B, and the set of column drivers 570B.

A similar type of redundancy may be used for the first and second sets of column drivers 570B and 580B. That is, if a failure occurs in the first or second sets of column drivers 570B and 580B, the column of switching elements 511C can be opened to isolate the left portion 513B of the pixel array from the right portion 514B, and the failed side of the display can be turned off while leaving the other side functional.

While the various embodiments have been shown and described in example forms of a redundant AMLCD system, it will be apparent to those skilled in the art that a method for providing redundancy in the event of a failure of row drivers may be performed using various components of the system as described above. Further, while the example describes an AMLCD system, the concepts described herein are also applicable to other display systems which use an active matrix of transistors to display information, such as an organic LED (OLED) array.

Figure 6A:
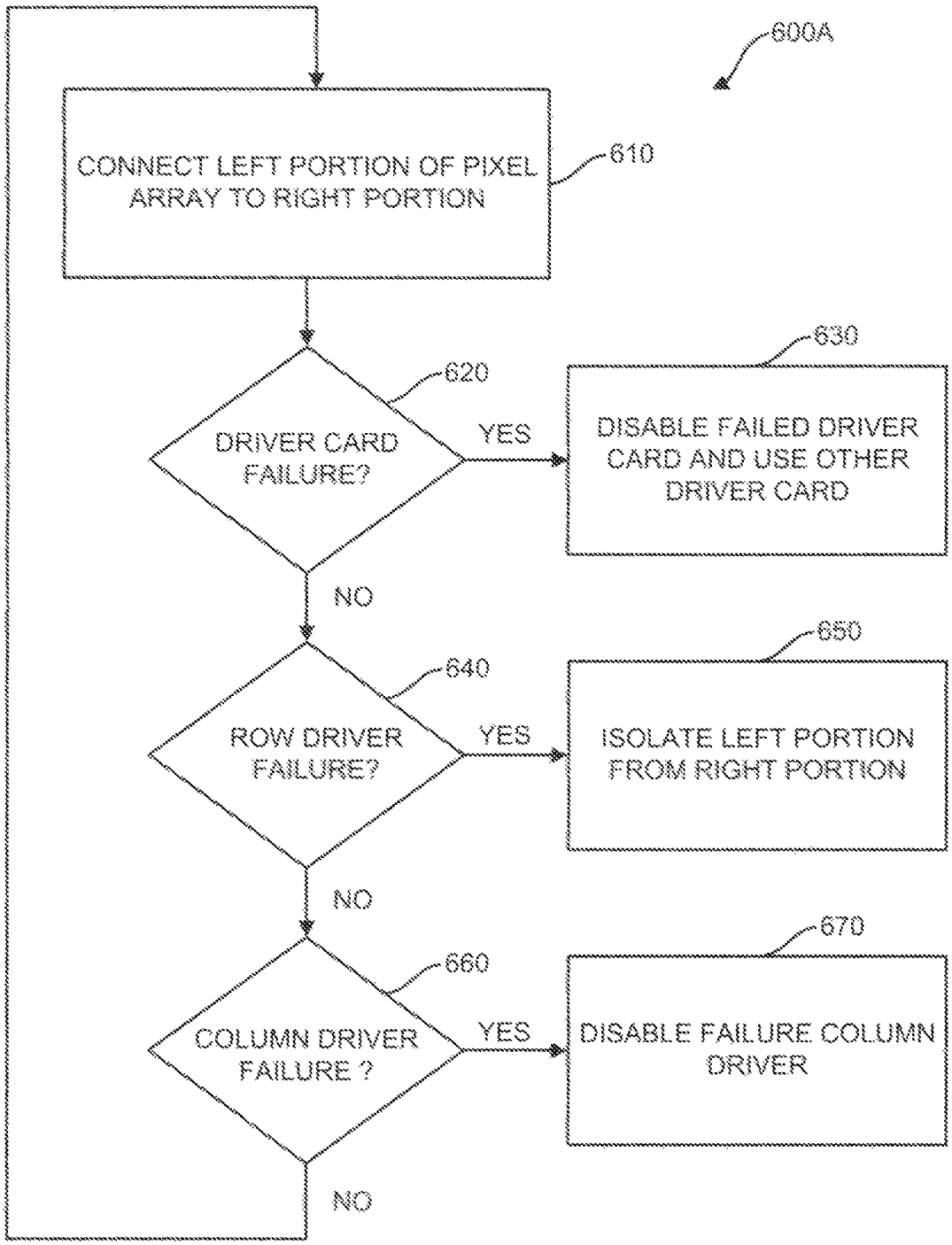
FIG. 6A illustrates a method for operating a redundant display according to one illustrative embodiment.

FIG. 6A illustrates a method 600A for operating a redundant display according to an illustrative embodiment. At step 610, a column of switching elements connects left row portions extending across a left portion of a pixel array to right row portions extending across a right portion of a pixel array to cause an image to be displayed across the entire pixel array. At step 620, if a failure in a driver card occurs, the failed driver card is disabled, and the other driver card is used to drive the row drivers and column drivers at step 630.

At step 640, if a row driver failure occurs, the column of switching elements isolates the left row portions from the right row portions at step 650, such that the image is displayed only across a left portion or a right portion of the pixel array. This isolation in response to a failure may be performed in the manner described above with reference to FIGS. 2, 3, and 4.

At step 660, if a column driver failure occurs, the failed column driver is disabled, and the non-failing column drivers continue to drive the pixel array at step 670.

If no failure occurs, the method returns to step 610, and the column of switching elements continues to connect the left row portions to the right row portions.

Figure 6B:
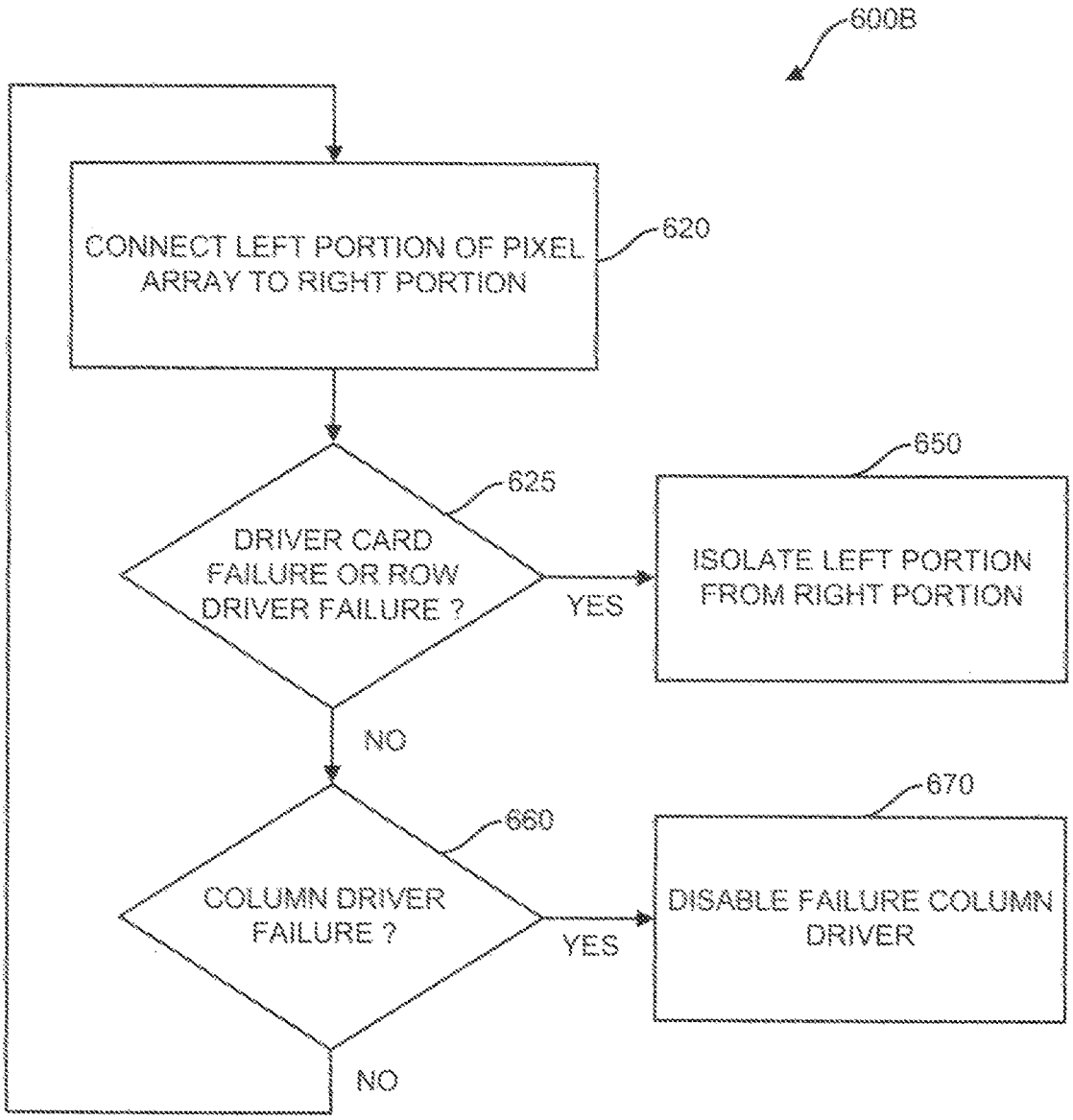
FIG. 6B illustrates a method for operating a redundant display according to another illustrative embodiment.

FIG. 6B illustrates a method 600B for operating a redundant display according to another illustrative embodiment. At step 610, a column of switching elements connects left row portions extending across a left portion of a pixel array to right row portions extending across a right portion of a pixel array to cause an image to be displayed across the entire pixel array. At step 625, if a failure in a driver card or a failure in a row driver occurs, the column of switching elements isolates the left row portions from the right row portions at step 650, such that the image is displayed only across a left portion or a right portion of the pixel array. This isolation in response to a failure may be performed in the manner described above with reference to FIGS. 2, 3, and 4.

At step 660, if a column driver failure occurs, the failed column driver is disabled, and the non-failing column drivers continue to drive the pixel array at step 670.

If no failure occurs, the method returns to step 610, and column of switching elements continues to connect the left row portions to the right row portions It should be appreciated that the methods 600A and 600B may include additional or alternative steps, e.g., a step for isolating left, middle and right row portions. Further, it should be appreciated that the steps for detecting failures may occur in any order.

While the various embodiments have been shown and described in example forms, it will be apparent to those skilled in the art that many modifications, additions, and deletions can be made therein without departing from the spirit and scope of the invention as defined by the following claims.

What is claimed is:

1. A redundant active matrix display system, comprising:

a first set of row drivers;

a second set of row drivers; a set of column drivers; and a layer of thin-film-transistors (TFTs) arranged in a pixel array and comprising:

a plurality of rows of conductors and TFTs, each row extending from left to right across the entire pixel array and connecting to both the first set of row drivers and the second set of row drivers, the first and second sets of row drivers arranged on respective sides of the pixel array and controlling voltages applied across each row in tandem;

a plurality of columns of conductors and TFTs controlled by the set of column drivers, each column extending from top to bottom across the pixel array; and one or more columns of switching elements extending from the top to the bottom of the pixel array, the one or more columns of switching elements disposed between the plurality of columns of conductors and TFTs in a left portion of the pixel array and the plurality of columns of conductors and TFTs in a right portion of the pixel array, wherein during normal operation, the one or more columns of switching elements connect left row portions with right row portions, such that voltages are applied to the rows to cause an image to be displayed across the entire pixel array;

wherein responsive to a malfunction of one of the sets of row drivers on one side of the pixel array, the one or more columns of switching elements are opened, isolating the left row portions from the right row portions, such that voltages from the other set of row drivers on the other side of the pixel array are applied to row portions on a side of the one or more columns of switching elements corresponding to the other side of the pixel array to cause the image to be displayed only across the left portion or the right portion of the pixel array.

2. The redundant active matrix display system of claim 1, wherein the plurality of rows of conductors and TFTs include respective middle portions extending across a middle portion of the pixel array between the left portion and the right portion, and the one or more columns of switching elements include two or more columns of switching elements extending from the top to the bottom of the pixel array, wherein each column of switching elements is disposed between the conductors and TFTs to the left of the one or more columns of switching elements and conductors and TFTs to the right of the one or more columns of switching elements.

3. The redundant active matrix display system of claim 2, wherein in response to a malfunction of one portion of the pixel array, one of the one or more columns of switching elements isolates the malfunctioning portion from the non-failed portions, such that voltages are applied to cause the image to be displayed only across the non-failed portions of the pixel array.

4. The redundant active matrix display system of claim 2, further comprising a backlight which functions as a single unit supplying light to the entire pixel array or as a first backlight supplying light to the left portion of the pixel array, a second backlight supplying light to a middle portion of the pixel array, and a third backlight supplying light to the right portion of the pixel array.

5. The redundant active matrix display system of claim 1, wherein during normal operation, voltages applied to the rows across the pixel array are the same, resulting in uniform color and brightness in an image displayed across the pixel array.

6. The redundant active matrix display system of claim 1, wherein the one or more columns of switching elements include a plurality of transistors that turn on during normal operation of the system to connect the left row portions with the right row portions and turn off responsive to malfunction of one side of the pixel array to isolate the left row portions from the right row portions.

7. The redundant active matrix display system of claim 1, wherein the one or more columns of switching elements include a plurality of fuses that pass current during normal operation of the system to connect the left row portions with the right row portions and open responsive to malfunction of one side of the pixel array to isolate the left row portions from the right row portions.

8. The redundant active matrix display system of claim 1, wherein the one or more columns of switching elements include a plurality of high impedance resistors that connect the left row portions with the right row portions during normal operation of the system and minimize current flow between the left row portions and the right row portions in the event of a malfunction of one side of pixel array.

9. The redundant active matrix display system of claim 1, further comprising a backlight which functions as a single unit supplying light to the entire pixel array or as a first backlight and a second backlight supplying light to the left portion of the pixel array and the right portion of the pixel array, respectively.

10. The redundant active matrix display system of claim 1, wherein during normal operation of the system, the set of column drivers outputs voltages across the entire width of the pixel array.

11. The redundant active matrix display system of claim 1, wherein responsive to a malfunction of one side of the pixel array or responsive to a user command, column drivers controlling the portion of the pixel array that is also controlled by a malfunctioning set of row drivers output voltages that cause a black screen image to be displayed.

12. A method for operating a redundant active matrix display including a layer of thin-film-transistors (TFTs) arranged in a pixel array including a plurality of rows of conductors and TFTs, each row extending from left to right across the entire pixel array, and a plurality of columns of conductors and TFTs, each column extending from top to bottom across the pixel array, the method comprising:

during normal operation of the display, connecting, by one or more columns of switching elements extending from the top to the bottom of the pixel array, left row portions of the layer of TFTs extending across a left portion of the pixel array to right row portions of the layer of TFTs extending across a right portion of the pixel array, such that voltages are applied to cause an image to be displayed across the entire pixel array, wherein the left row portions and the right row portions of the layer of TFTs are controlled by a first set of row drivers and a second set of row drivers, the first and second sets of row drivers arranged on respective sides of the pixel array and controlling voltages applied across each row in tandem; and responsive to a malfunction of one of the sets of row drivers on one side of the pixel array, isolating, by the one or more columns of switching elements, the left row portions from the right row portions, such that voltages from the other set of row drivers on the other side of the pixel array are applied to row portions on a side of the column switching elements corresponding to the other side of the pixel array which cause the image to be displayed only across the left portion or the right portion of the pixel array.

13. The method of claim 12, wherein the plurality of rows of conductors and TFTs include respective middle portions extending across a middle portion of the pixel array between the left portion and the right portion, and the columns of switching elements include two or more columns of switching elements extending from the top to the bottom of the pixel array, wherein each column of the columns of switching elements is disposed between the plurality of rows of conductors and TFTs to the left of the column of switching elements and the plurality of rows of conductors and TFTs to the right of the column of switching elements.

14. The method of claim 13, further comprising:

responsive to a malfunction of a portion of the pixel array, isolating the malfunctioning portion from the non-failed portions, such that voltages are applied to cause the image to be displayed only across the non-failed portions of the pixel array.

15. The method of claim 12, wherein during normal operation of the display, voltages applied to the row portions across the pixel array are the same, resulting in uniform color and brightness in an image displayed across the pixel array.

16. The method of claim 12, wherein the first set and the second set of row drivers are driven by a first driver card, the method further comprising:

responsive to a failure of the first driver card, disabling the first driver card and driving the first set and the second set of row drivers by a second driver card.

17. The method of claim 12, wherein the first set of row drivers is driven by a first driver card, and the second set of row drivers is driven by a second driver card, the method further comprising:

responsive to a failure of the first driver card or the second driver card, isolating, by the column of switching elements, the left row portions from the right row portions.

18. The method of claim 12, wherein the plurality of columns of conductors and TFTs are controlled by at least one set of column drivers, wherein during normal operation, the set of column drivers output voltages across the entire width of the pixel array.

19. The method of claim 18, further comprising:

responsive to a malfunction of a column driver, disabling the column driver.

* * * * *